US008381458B2

(12) United States Patent
Rider, Jr. et al.

(10) Patent No.: US 8,381,458 B2
(45) Date of Patent: Feb. 26, 2013

(54) VENT BAFFLES

(75) Inventors: Edward W. Rider, Jr., Slate Hill, NY (US); Alex P. Augustin, Sparrow Bush, NY (US); Christian D. Lisowy, Middletown, NY (US); Steven M. Driesse, Cornwall on Hudson, NY (US)

(73) Assignee: Genpak LLC, Glens Falls, NY (US)

( * ) Notice: Subject to any disclaimer, the term of this patent is extended or adjusted under 35 U.S.C. 154(b) by 181 days.

(21) Appl. No.: 12/337,493

(22) Filed: Dec. 17, 2008

(65) Prior Publication Data

US 2010/0146892 A1 Jun. 17, 2010

(51) Int. Cl.
*E04B 7/00* (2006.01)
*E04D 3/40* (2006.01)
*E04D 13/00* (2006.01)

(52) U.S. Cl. ..... 52/95; 52/302.3

(58) Field of Classification Search ..... 52/94, 95, 52/198, 199, 302.1, 302.3
See application file for complete search history.

(56) References Cited

U.S. PATENT DOCUMENTS

| | | | | |
|---|---|---|---|---|
| 2,707,117 | A * | 4/1955 | Fentress et al. | 285/226 |
| 3,222,697 | A | 12/1965 | Scheermesser | |
| 3,842,865 | A * | 10/1974 | Torricelli | 138/121 |
| 4,096,790 | A | 6/1978 | Curran | |
| 4,184,416 | A | 1/1980 | Koontz | |
| 4,189,878 | A | 2/1980 | Fitzgerald | |
| 4,380,573 | A * | 4/1983 | Naslund | 428/595 |
| 4,576,206 | A | 3/1986 | Lauren | |
| 5,013,597 | A | 5/1991 | Kracke | |
| 5,051,293 | A | 9/1991 | Breitscheidel et al. | |
| 5,310,594 | A | 5/1994 | Holland et al. | |
| 5,341,612 | A * | 8/1994 | Robbins | 52/95 |
| 5,347,776 | A * | 9/1994 | Skoff | 52/219 |
| 5,390,451 | A * | 2/1995 | Kopp et al. | 52/58 |
| 5,519,907 | A | 5/1996 | Poths | |
| 5,600,928 | A * | 2/1997 | Hess et al. | 52/309.4 |
| 5,772,502 | A * | 6/1998 | Smith | 454/365 |
| 5,843,353 | A | 12/1998 | De Vos et al. | |
| 5,900,299 | A | 5/1999 | Wynne | |
| 6,110,310 | A | 8/2000 | Eyhorn et al. | |
| 6,346,040 | B1 | 2/2002 | Best | |
| 6,347,991 | B1 | 2/2002 | Bogrett et al. | |
| D533,328 | S * | 12/2006 | Wake | D34/38 |
| 7,302,776 | B2 | 12/2007 | Duncan et al. | |
| 8,096,326 | B2 * | 1/2012 | Palmeri | 138/121 |
| 2001/0034499 | A1 | 10/2001 | Sessions et al. | |
| 2002/0017331 | A1 * | 2/2002 | Renaud | 138/121 |
| 2002/0104772 | A1 | 8/2002 | Hnatow et al. | |
| 2003/0082343 | A1 | 5/2003 | Brucker | |
| 2007/0151177 | A1 * | 7/2007 | Mumaw et al. | 52/198 |

FOREIGN PATENT DOCUMENTS

| | | | |
|---|---|---|---|
| DE | 3524574 | A1 | 1/1987 |
| DE | 3924801 | A1 | 2/1991 |
| DE | 4119661 | A1 | 12/1992 |
| DE | 4139771 | A1 | 6/1993 |
| DE | 10305571 | A1 | 8/2004 |
| JP | 2003326560 | A | 11/2003 |
| JP | 2004155476 | A | 6/2004 |
| WO | WO 03/037599 | A1 | 5/2003 |

* cited by examiner

*Primary Examiner* — William Gilbert
*Assistant Examiner* — Theodore Adamos
(74) *Attorney, Agent, or Firm* — Stoel Rives LLP

(57) ABSTRACT

A vent baffle can be arranged so as to direct air near an underside of a roof. The vent baffle can feature bending structures, which can allow the vent baffle to transition from a substantially columnar orientation to a bent orientation.

36 Claims, 14 Drawing Sheets

VENT BAFFLES

TECHNICAL FIELD

Embodiments disclosed herein relate generally to vent structures for directing air past an underside of a roof.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Roofing structures can be susceptible to a variety of harmful phenomena if they are not provided with adequate ventilation. For example, condensation can occur at an underside of a roof that is not properly ventilated, which can result in icing, mold growth, or other deteriorative effects. Accordingly, a variety of venting systems have been developed for roofing structures. Certain of such venting systems can employ vent baffles.

Figure 1:
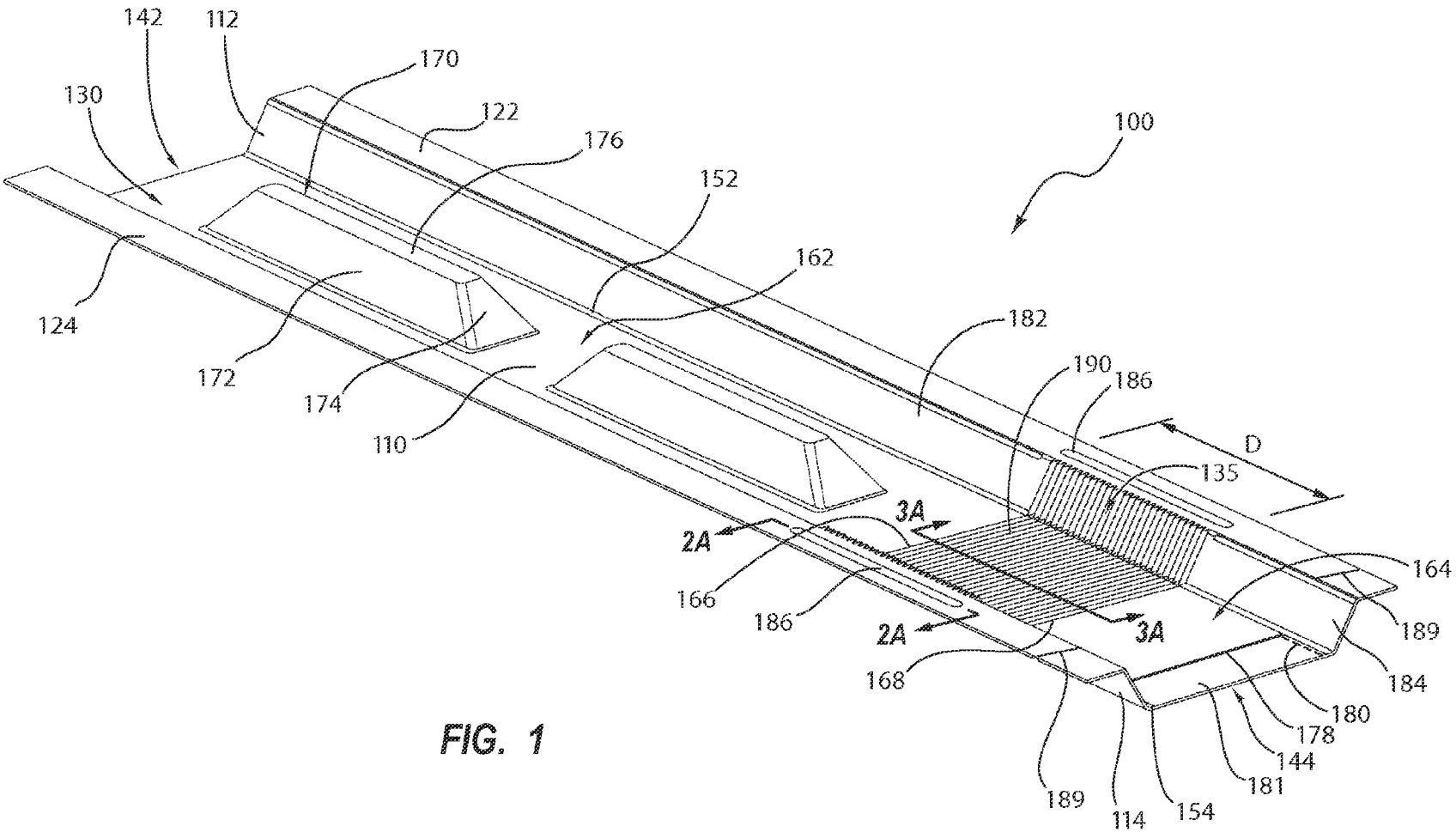
FIG. 1 illustrates a top perspective view of an embodiment of a vent baffle.

With reference to FIG. 1, in certain embodiments, a vent baffle 100 comprises a base wall 110, a first side wall 112, a second side wall 114, a first attachment flange 122, and a second attachment flange 124. The base wall 110 and the side walls 112, 114 can cooperate to define a channel 130. In some embodiments, the vent baffle 100 comprises a bending region 135. The vent baffle 100 can define a top end 142 and a bottom end 144. In some embodiments, the top end 142 is configured to be positioned at an underside of a roof and directed toward an upper end of the roof, and the bottom end 144 is configured to be positioned at or near a soffit region, as further discussed below. Directional terms, such as upper, top, bottom, etc., are used herein by way of convenience and not limitation. While these terms can correspond with the orientations of various illustrative embodiments, as depicted in the figures and as described, it is noted that other suitable arrangements and orientations are possible.

In some embodiments, the base wall 110 extends from the top end 142 to the bottom end 144 of the vent baffle 100 in a longitudinal direction. Likewise, the base wall 110 can extend between a first side edge 152 and a second side edge 154. In many embodiments, the base wall 110 is elongated in the longitudinal direction such that a length of the base wall 110, as measured between the top end 142 and the bottom end 144 of the vent baffle 100, is greater than a maximum width of the base wall 110, as measured between the first side edge 152 and the second side edge 154. In some embodiments, the base wall 110 is substantially planar.

In some embodiments, the base wall 110 comprises multiple regions. For example, in the embodiment illustrated in FIG. 1, the base wall 110 can comprise an upper region 162 and a lower region 164 that are separated from each other by a portion of the bending region 135. Stated otherwise, in some embodiments, the base wall 110 can comprise at least a portion of the bending region 135, which can separate the upper region 162 from the lower region 164. In some embodiments, the upper region 162 defines a first intermediate edge 166 and the lower region 164 defines a second intermediate edge 168. In some embodiments, the bending region 135 extends between the first and second intermediate edges 166, 168.

In certain embodiments, one or more sections of the base wall 110 are substantially planar. For example, in some embodiments, each of the upper and lower regions 162, 164 comprises a substantially planar surface, which in further embodiments can be generally smooth. In some embodiments, a portion of the bending region 135 disposed within the base wall 110 can also be generally planar, although a surface of the bending region 135 may be rippled, as further discussed below.

In some embodiments, the base wall 110 can comprise one or more structural ribs 170. In some embodiments, the ribs 170 can extend in the longitudinal direction, and can be raised relative to the base wall 110. In some embodiments, the ribs 170 comprise opposing side surfaces 172 and opposing frontal surfaces 174 that taper inward toward a top surface 176, which can be substantially planar. In some embodiments, the side surfaces 172 and the frontal surfaces 174 are substantially trapezoidal. Other shapes and arrangements are also possible. For example, in some embodiments, the ribs 170 can include substantially rectangular side, frontal, and top surfaces 172, 174, 176.

The ribs 170 can provide the base wall 110 with structural support. For example, the ribs 170 can inhibit bending or twisting of the base wall 110. In further embodiments, the ribs 170 can prevent the base wall 110 from being crushed or otherwise deformed so as to block the channel 130. For example, in some embodiments, the top surfaces 176 of the ribs 170 are placed proximate to (e.g., near or adjacent) an underside of a roof such that the ribs 170 can support the base wall 110 as pressure is applied to an underside (not shown in FIG. 1) of the vent baffle 100, such as by loose insulation that is compacted against the vent baffle 100. In other embodiments, the vent baffle 100 does not include ribs 170.

In some embodiments, the base wall 110 includes a folding line 178 at a bottom end of the base wall 110. The folding line 178 can comprise a score line, a molded indentation, or any other suitable feature configured to facilitate folding. In further embodiments, the base wall 110 includes one or more lines of weakness 180, which can, for example, comprise perforations. In some embodiments, the lines of weakness can extend along a portion of the first and second side edges 152, 154 of the base wall 110. The lines of weakness 180 can facilitate separation of a tab portion 181 of the base wall 110 from the side walls 112, 114, and the tab portion 181 can be folded along the folding line 178. A system of folding lines 178 and/or lines of weakness 180 as just described can facilitate attachment of the vent baffle 100 in a soffit region. For example, in some embodiments, the tab portion 181 can be attached (e.g., via staples) to a top plate of a roofing structure, as further discussed below.

With continued reference to FIG. 1, in some embodiments, each of the first and second side walls 112, 114 extends upwardly from the base wall 110. For example, in some embodiments, each of the first and second walls 112, 114 extends at an angle relative to the base wall 10 such that it is nonlinear with or is nonparallel to the base wall 110. The first side wall 112 can extend upwardly from the first side edge 152 of the base wall 110 and the second side wall 114 can extend upwardly from the second side edge 154 of the base wall 110. In some embodiments, one or more of the first and second side walls 112, 114 can be substantially planar.

In some embodiments, one or more of the first and second side walls 112, 114 can comprise a portion of the bending region 135. For example, in the illustrated embodiment, a portion of the bending region 135 is positioned between a first substantially planar section 182 and a second substantially planar section 184 of the first side wall 112. Similarly, a portion of the bending region 135 is disposed between substantially planar sections (not shown) of the second side wall 114.

In some embodiments, the first attachment flange 122 extends from an upper end of the first side wall 112 and the second attachment flange 124 extends from an upper end of the second side wall 114. The attachment flanges 122, 124 can be angled relative to the side walls 112, 114, and can facilitate attachment of the vent baffle 100 to an underside of a roof. For example, in some embodiments, the attachment flanges 122, 124 can extend outward from a main body of the vent baffle 100 so as to be substantially parallel to an underside of a roof, and can be secured to the roof in any suitable fashion, such as via staples, tacks, or other suitable devices. In other embodiments, the attachment flanges 122, 124 can be secured to rafters in addition to or instead of being secured to the roof.

In many embodiments, the vent baffle 100 is sized such that it can be secured to a roofing structure between adjacent rafters. For example, in some embodiments, a width of the vent baffle 100, as measured between outer edges of the attachment flanges 122, 124 is about the same as or is slightly smaller than a distance between adjacent rafters. In various common roofing structures, the distance between the centers of adjacent rafters is approximately 12 inches, approximately 16 inches, or approximately 24 inches. In various embodiments compatible with such roofing structures, the distance between outer edges of the attachment flanges 122, 124 can be within a range of between about 10.0 inches and about 11.5 inches, between about 13.0 inches and about 15.5 inches, or between about 20.0 inches and about 23.5 inches. Other distances are also possible.

With continued reference to FIG. 1, in some embodiments, the vent baffle 100 comprises one or more structural reinforcement members 186 that are configured to provide enhanced rigidity near the bending region 135 and to inhibit undesired bending of the vent baffle 100. In some embodiments, the one or more reinforcement members 186 extend alongside the bending region 135. In further embodiments, the reinforcement members can define a length in the longitudinal direction that is greater than a longitudinal extent of the bending region 135. For example, in the illustrated embodiment, the longitudinal extent of the bending region 135 is depicted as a distance D, which is the distance between the first and second intermediate edges 166, 168 of the base wall 110. The length of the reinforcement members 186 can be greater than the distance D.

Figure 2A:
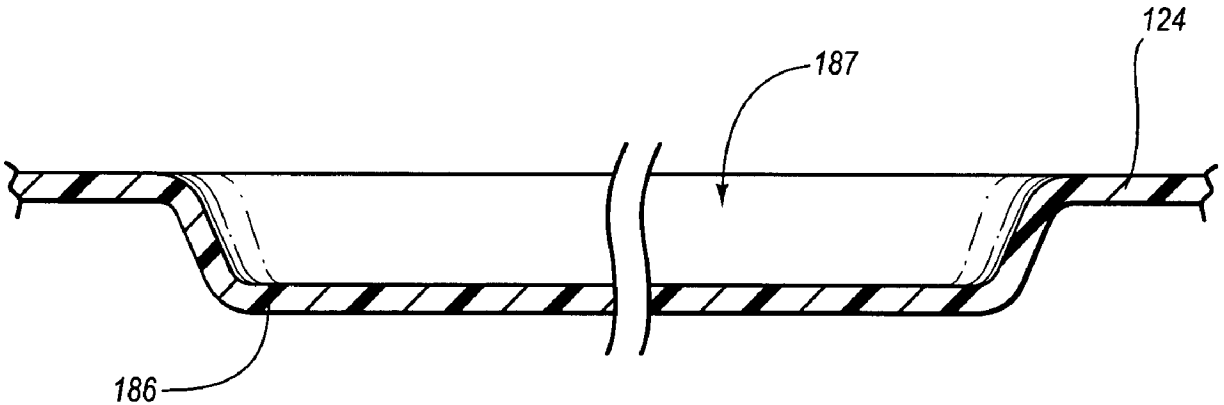
FIG. 2A illustrates a cross-sectional view of a portion of the vent baffle of FIG. 1 taken along the view line 2A-2A of FIG. 1.

With reference to FIG. 2A, in some embodiments, the structural reinforcement members 186 are integrally formed with the first and second attachment flanges 122, 124. For example, in some embodiments, the reinforcement members 186 comprise a longitudinally extending structural rib 187. In the illustrated embodiment, the rib 187 defines both a concavity (e.g., as viewed from above) and a protrusion (e.g., as viewed from below). In other embodiments, the structural rib 187 can define a thickened region of the attachment flanges 122, 124. For example, rather than defining both a concavity and a protrusion, the rib 187 can define a protrusion as viewed from above and/or as viewed from below.

Figure 2B:
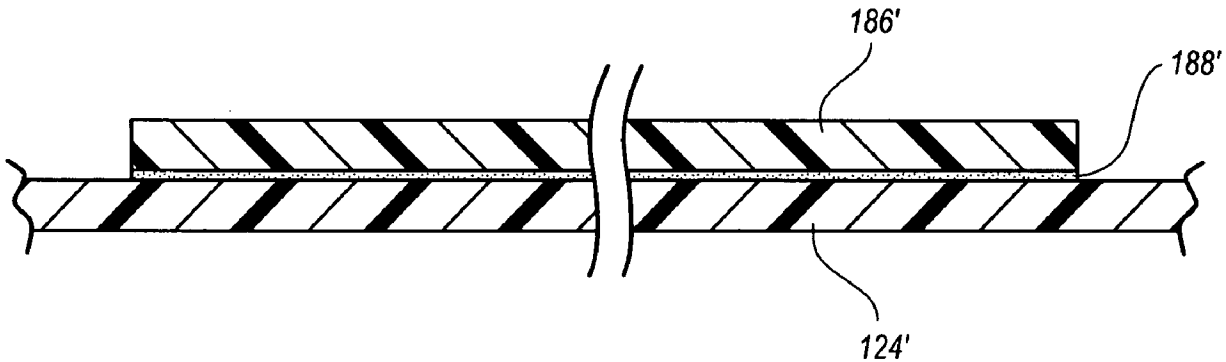
FIG. 2B illustrates a cross-sectional view of a portion of another embodiment of a vent baffle taken along a view line such as the view line 2A-2A of FIG. 1.

With reference to FIG. 2B, in some embodiments, reinforcement members 186' can be secured to attachment flanges 122', 124'. For example, in some embodiments, the reinforcement members 186' can comprise a rigid material that is less prone to bending than the material of which the first and attachment flanges 122', 124' are comprised. The reinforcement members 186' can integrally formed with or secured to the attachment flanges 122', 124' in any suitable manner. For example, in the illustrated embodiment, an adhesive 188' bonds the reinforcement member 186' to the attachment flange 124'.

With reference again to FIG. 1, in many embodiments, the reinforcement members 186 provide sufficient strength to inhibit inadvertent bending of the vent baffle 100, such as during transport of the vent baffle 100. However, the reinforcement members 186 can be configured to yield when greater forces are applied to the vent baffle 100 to intentionally move it into a bent orientation, such as during installation. In other embodiments, the reinforcement members 186 (e.g., embodiments of the reinforcement members 186' described above) can be detachable from the vent baffle 100 such that the reinforcement members 186 can be maintained in place during transport of the vent baffle 100 and removed during installation.

In some embodiments, the attachment flanges 122, 124 can comprise folding lines 189 such as the folding line 178 discussed above. In some embodiments, the side walls 112, 114 can also comprise folding lines (not shown). Accordingly, in some embodiments, a full section at the bottom end 144 of the vent baffle 100 can be folded easily along a substantially continuous folding line for attachment to a roofing structure. In certain of such embodiments, lines of weakness 180 at the bottom end 144 of the vent baffle 100 can be left intact.

With continued reference to FIG. 1, in certain embodiments, the bending region 135 is configured to permit the vent baffle 100 to transition between a substantially columnar orientation and a bent orientation. FIG. 1 illustrates the vent baffle 100 in a substantially columnar orientation. As shown in this figure, in some embodiments, the upper and lower regions 162, 164 of the base wall 110 are substantially aligned with each other (e.g., coplanar) when the vent baffle 100 is in the substantially columnar orientation. Such an arrangement can be particularly well-suited for certain shipping and transport applications due to the relatively low profile of the vent baffle 100. Additionally, in some embodiments, multiple vent baffles 100 can be stackable so as to conserve space, which can also be advantageous for purposes shipping or transport.

The vent baffle 100 can be configured to transition to a bent orientation for installation in a roofing structure (see, e.g., FIGS. 4, 8, and 9), as further discussed below. In some embodiments, a first portion of the vent baffle 100 can be positioned such that it is out of alignment relative to a second portion of the vent baffle 100 to transition the vent baffle 100 to the bent orientation. For example, in some embodiments, the lower region 164 of the base wall 110 can be rotated such that it extends at an angle relative to the upper region 162 of the base wall 110 (e.g., such that the upper and lower regions 162, 164 are nonparallel to each other).

With continued reference to FIG. 1, in certain embodiments, the bending region 135 spans a significant portion of the vent baffle 100. For example, in some embodiments, the distance D (discussed above) can be within a range of between about 1/20 and about 1/4 the longitudinal length of the vent baffle 100. In other embodiments, the distance D can be between about 1/10 and about 1/5 the length of the vent baffle 100.

In certain embodiments, the vending region 135 comprises a plurality of accordion pleats 190 that are arranged serially (e.g., one after another) and that can be adjacent to one another. Any suitable number of accordion pleats 190 is possible. For example, in various embodiments, the bending region 135 can comprise between 10 and 40 pleats, between 20 and 35 pleats, or between 25 and 30 pleats in serial arrangement.

In some embodiments, the accordion pleats 190 extend in a direction that is substantially transverse to a longitudinal axis defined by the vent baffle 100. For example, the accordion pleats 190 can extend in a direction that is substantially perpendicular to a longitudinal length of the base wall 10 (e.g., perpendicular to the first side edge 152 in the illustrated embodiment).

As further discussed below, in some embodiments, the accordion pleats 190 can extend across different sections of the vent baffle 100. For example, in the illustrated embodiment, each of the accordion pleats 190 extends from a top edge of the first side wall 112 to the first side edge 152 of the base wall 110, across the base wall 110 to the second side edge 154, and up to a top edge of the second side wall 114. One or more of the accordion pleats 190 can be substantially continuous or uninterrupted along this path between the top edge of the first side wall 112 and the top edge of the second side wall 114. In other embodiments, one or more of the pleats 190 may extend across a greater or smaller portion of the vent baffle 100. For example, in some embodiments, one or more of the pleats 190 can extend from an outer edge of the first attachment flange 122 to an outer edge of the second attachment flange 124. In other embodiments, one or more pleats 190 can extend from an outer edge of the first attachment flange 122 to the first side edge 152 of the base wall 110, and one or more additional accordion pleats 190 can extend from an outer edge of the second attachment flange 124 to the second side edge 154 of the base wall 110. Other arrangements are also possible.

Figure 3B:
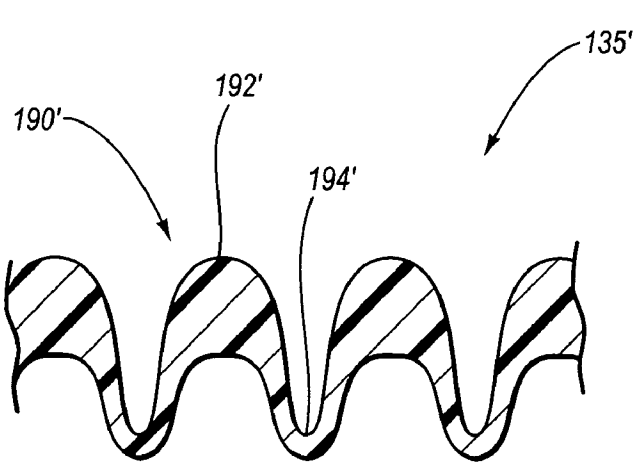
FIG. 3B illustrates a cross-sectional view of a portion of another embodiment of a vent baffle taken along a view line such as the view line 3A-3A of FIG. 1.
Figure 3A:
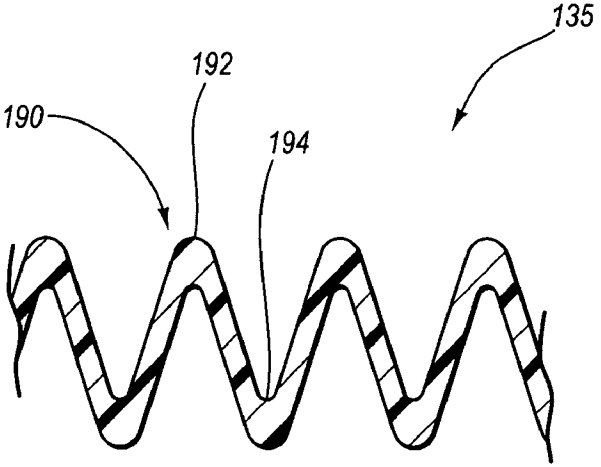
FIG. 3A illustrates a cross-sectional view of a portion of the vent baffle of FIG. 1 taken along the view line 3A-3A of FIG. 1.

FIG. 3A illustrates a cross-sectional view of a portion of one embodiment of a bending portion 135 that comprises accordion pleats 190. The term "accordion pleat" is used expansively herein, is intended to connote the ordinary meaning of this term, and can include hinged structures, rippled structures, spring-like structures, and/or other structures of which at least a portion is configured to expand, enlarge, and/or separate (e.g., while remaining integrally unified), and/or of which at least a portion is configured to contract, compress, or condense (e.g., while remaining integrally unified).

As shown in FIG. 3A, in certain embodiments, a series of accordion pleats 190 can define a series of ridges 192 and valleys 194. Any suitable arrangement of the ridges 192 and valleys 194 is possible. For example, the ridges 192 and valleys 194 can repeat in regular patterns (e.g., can define a profile resembling a sine wave, a triangle wave, a square wave, etc.) or can be non-repetitive or irregularly shaped. In some embodiments, a cross-sectional profile of an upper surface of the accordion pleats 190 can be substantially the same as a cross-sectional profile of a lower surface of the accordion pleats. For example, in the illustrated embodiment, both the upper and lower surfaces of the accordion pleats 190 are substantially V-shaped. In still further embodiments, a thickness of the accordion pleats 190 can be substantially uniform, such as shown in the illustrated embodiment.

With reference to FIG. 3B, in other embodiments, a thickness of accordion pleats can be non-uniform. For example, in the illustrated embodiment of a bending region 135', which comprises accordion pleats 190' that define ridges 192' and valleys 194', the ridges 192' are substantially thicker than the valleys 194'. Additionally, in some embodiments, a cross-sectional profile of an upper surface of the accordion pleats can be different from a cross-sectional profile of a lower surface of the accordion pleats. For example, in the illustrated embodiment, the cross-sectional profile of the upper surface of the accordion pleats 190' defines steeper curves in the area of the valleys 194' than are defined by the lower surface of the accordion pleats 190'.

Figure 3C:
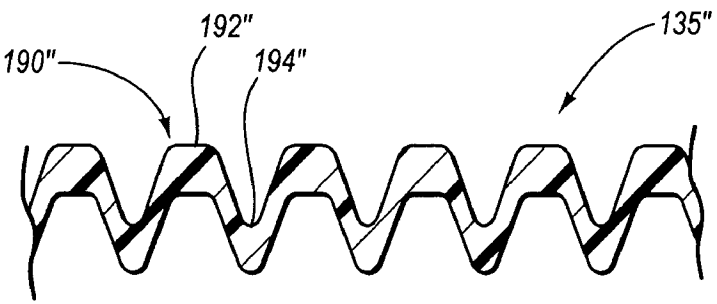
FIG. 3C illustrates a cross-sectional view of a portion of another embodiment of a vent baffle taken along a view line such as the view line 3A-3A of FIG. 1.

FIG. 3C illustrates another embodiment of a bending region 135". In the illustrated embodiment, accordion pleats 190" define ridges 192" having flat tops and relatively sharper valleys 194". Other suitable arrangements of accordion pleats are possible.

Figure 4:
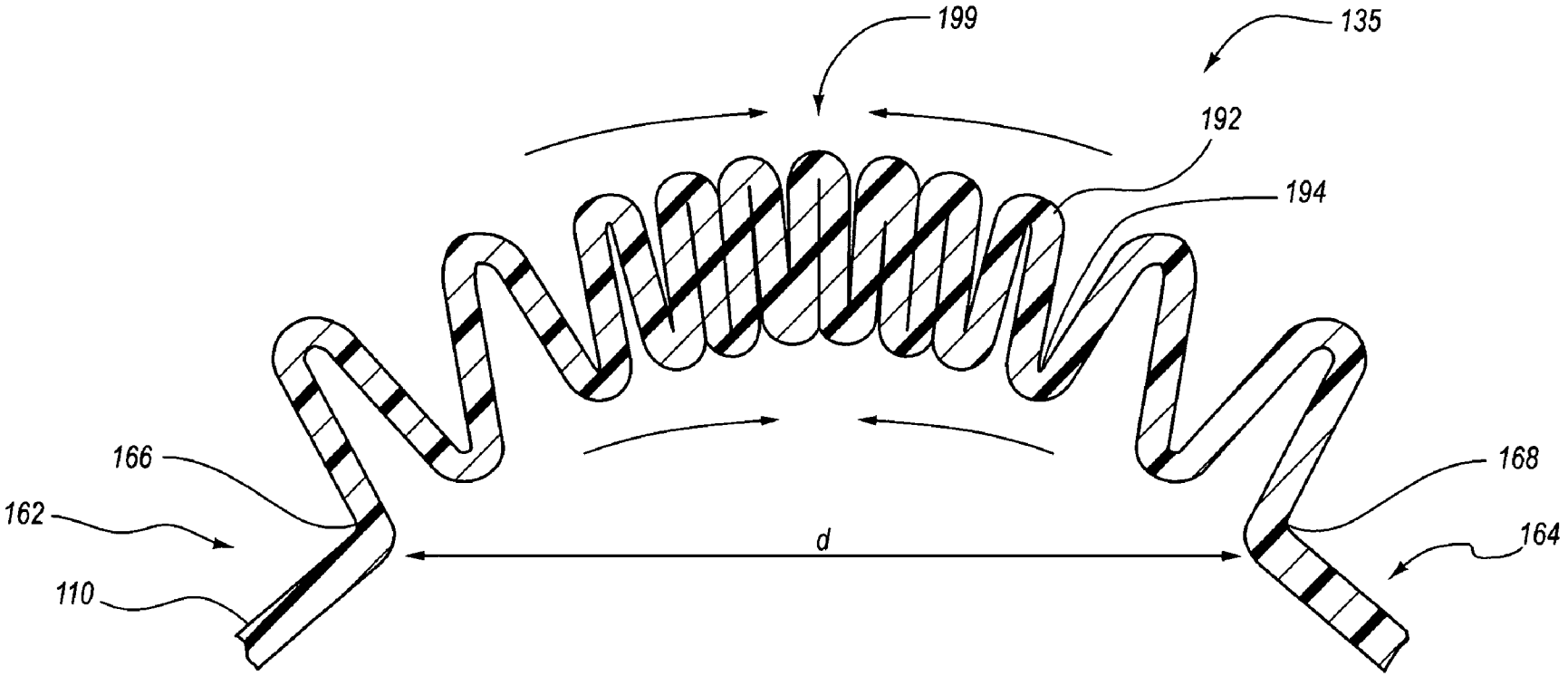
FIG. 4 illustrates a cross-sectional view of a portion of the vent baffle of FIG. 1 in a bent state taken along a view line such as the view line 3A-3A of FIG. 1.

With reference to FIGS. 1 and 4, in certain embodiments, at least a portion of the bending region 135 can be configured to be compressed or condensed as the vent baffle 100 transitions from the columnar configuration to the bent configuration. For example, in the illustrated embodiment, the ridges 192 and the valleys 194 of the accordion pleats 190 can act as hinges or springs, and can move from a natural configuration to a compressed or condensed configuration. In some embodiments, accordion pleats 190 that are closest to an apex 199 of the bending region 135 when it is in a bent configuration can undergo greater deformation (e.g., greater compression) than accordion pleats 190 at the outer edges of the bending region 135, such as, for example, those near the intermediate edges 166, 168 of the base wall 110.

In certain embodiments, the accordion pleats 190 can be caused to compress as the bottom end 144 of the vent baffle 100 is moved in a downward direction. For example, movement of the bottom end 144 in a downward direction can cause the attachment flanges 122, 124 to curve. However, in many embodiments, the material of which that attachment flanges 122, 124 are formed can be substantially resistant to linear expansion. Accordingly, although such material may bend, it is not prone to extension. As a result, in certain embodiments, ends of the accordion pleats 190 that terminate at the attachment flanges 122, 124 do not spread apart as the attachment flanges 122, 124 bend. Rather, the ends of the accordion pleats 190 maintain their spacing while remaining portions of the accordion pleats 190 are compressed. Accordingly, in some embodiments, portions of the accordion pleats 190 can compress without any portion of the accordion pleats 190 expanding significantly. As discussed below, in other embodiments, portions of the accordion pleats 190 can expand without any portion thereof compressing significantly, and in still other embodiments, portions of the pleats 190 can expand and other portions of the pleats 190 can contract as the vent baffle 100 transitions from the substantially columnar configuration to the bent configuration.

In certain embodiments, compression of the accordion pleats 190 can result in the upper and lower regions 162, 164 of the base wall 110 moving closer together. For example, in the substantially columnar configuration shown in FIG. 1, the first and second intermediate edges 166, 168 can be spaced from each other by the distance D. In the bent configuration shown in FIG. 4, the first and second intermediate edges 166, 168 can be spaced from each other by a distance d that is smaller than the distance D.

In certain embodiments, the vent baffle 100 comprises a material that is sufficiently rigid to permit the vent baffle 100 to be a self-supporting structure. In further embodiments, the vent baffle 100 can comprise a material that is somewhat flexible and that can deform elastically under relatively small deformations. Accordingly, in some embodiments, the vent baffle 100 can flex or bend by small amounts without creasing or breaking. In various embodiments, the vent baffle 100 comprises polystyrene (e.g., polystyrene foam), high impact polystyrene, rubber base polystyrene, polypropylene, or paper fiber. Any other suitable material is possible.

In some embodiments, the bending region 135 is integrally formed with the vent baffle 100. In some embodiments, the bending region 135 and other portions of the vent baffle 100 comprise a material capable of elastic deformation. In other embodiments, the material is configured to plastically deform. In other embodiments, the bending region 135 can be formed separately from and joined to the vent baffle 100.

Figure 5:
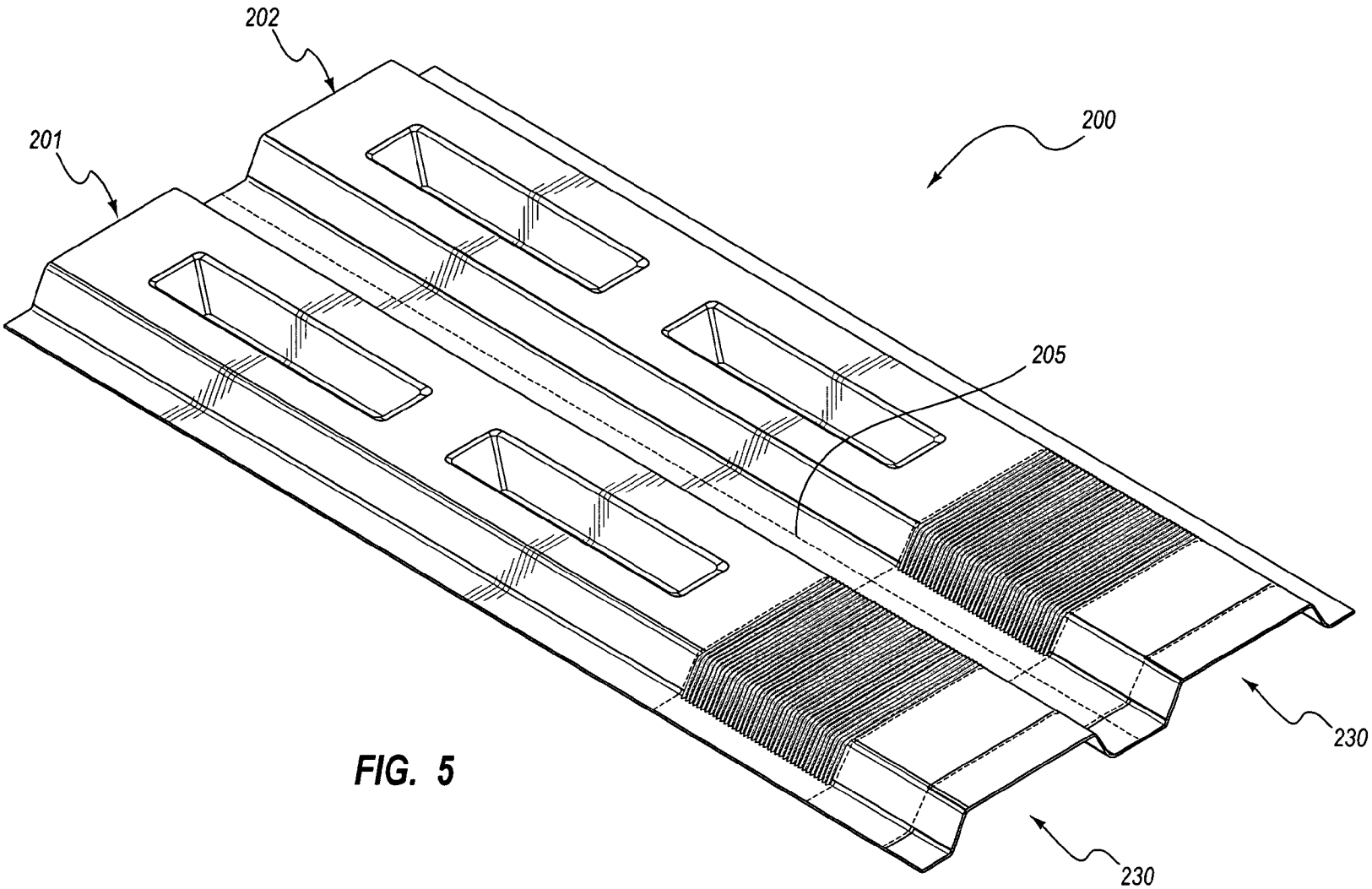
FIG. 5 illustrates a bottom perspective view of another embodiment of a vent baffle.

With reference to FIG. 5, in certain embodiments, a vent baffle 200 comprises a first vent baffle 201 and a second vent baffle 202. Each of the first and second vent baffles 201, 202 can resemble the vent baffle 100 described above. The vent baffles 201, 202 can be integrally formed, and can be separable from each other via a line of weakness 205, which can comprise perforations.

The vent baffle 200 can define two channels 230, each of which can resemble the channel 130 described above. Accordingly in some embodiments, the vent baffle 200 can be installed at an underside of a roof and can direct two columns of air past the roof via the channels 230. In further embodiments, the vent baffle 200 can be split along the line of weakness 205, and each of the vent baffles 201, 202 can be installed separately. The vent baffle 200 can, in some instances, be advantageous in that it can be configured for use with roofing structures having differently spaced rafters. For example, the vent baffle 200 can be particularly well suited for use with rafters spaced from each other on 24 inch centers as well as rafters spaced from each other on 12 inch centers.

Figure 6:
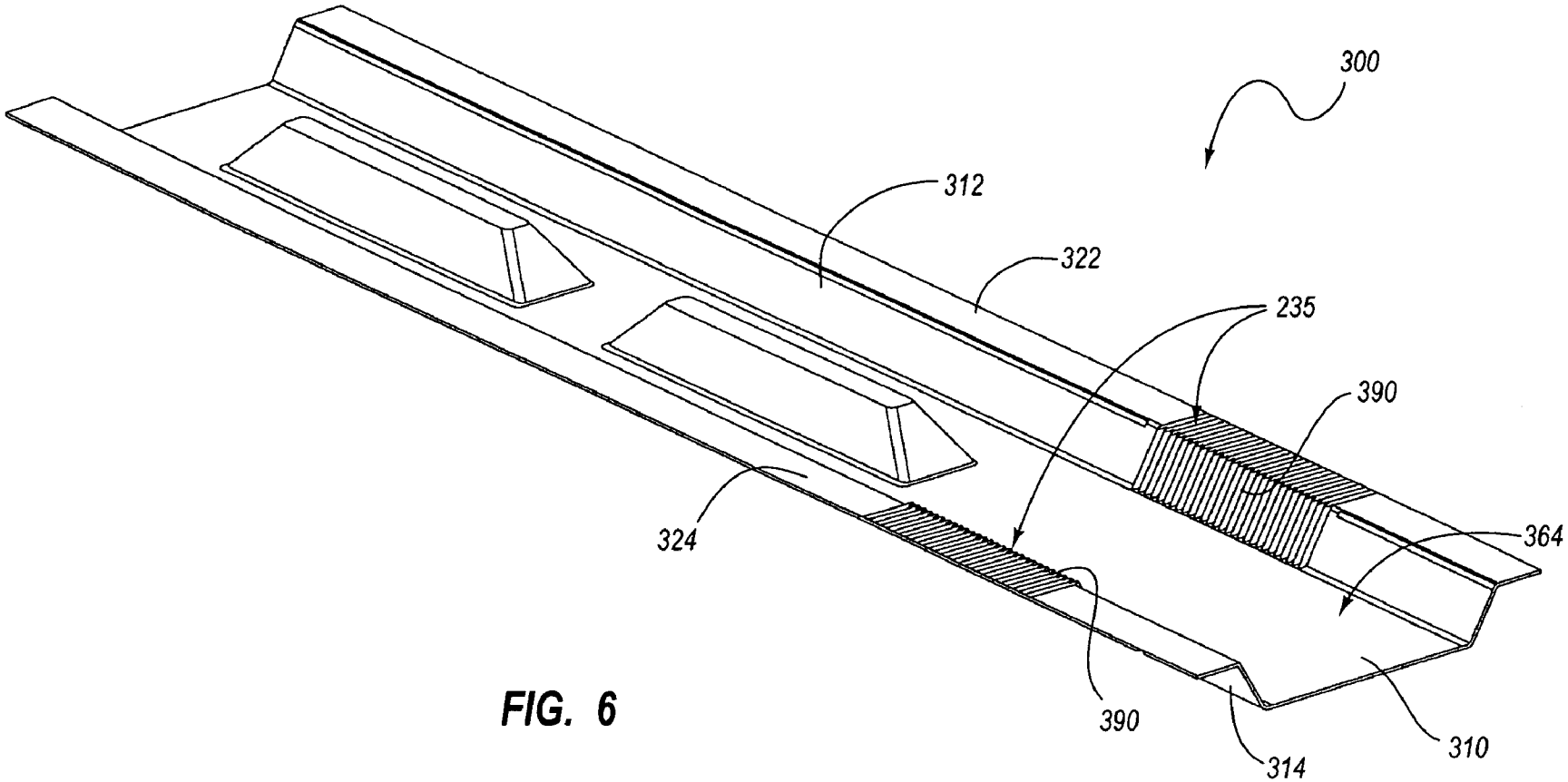
FIG. 6 illustrates a top perspective view of another embodiment of a vent baffle.

FIG. 6 illustrates another embodiment of a vent baffle 300 such as the vent baffle 100. In the illustrated embodiment, the vent baffle 300 does not include folding lines or lines of weakness such as the folding lines 178, 189 and lines of weakness 180 discussed above. Additionally, the vent baffle 300 comprises a bending structure 235 that differs from the embodiment of a bending structure 135 illustrated in FIG. 1. In particular, the bending structure 235 does not include accordion pleats within a base wall 310. Rather, the bending structure 235 includes a first set of accordion pleats 390 that extend from an outer edge of a first attachment flange 322 to a top edge of a first side wall 312, and from the top edge of the first side wall 312 to a bottom edge of the first side wall 312. The bending structure 235 further includes a second set of accordion pleats 390 that extend from an outer edge of a second attachment flange 324 to a top edge of a second side wall 314, and from the top edge of the second side wall 314 to a bottom edge of the second side wall 314.

In the illustrated embodiment, the accordion pleats 390 are configured to expand or spread apart as vent baffle 300 is bent. For example, the base wall 310 can comprise a material that is relatively resistant to compression and/or because of its substantially planar configuration, can comprise columnar strength in the longitudinal direction. Accordingly, as a lower region 364 of the base wall 310 is urged in a downward direction, the spacing of the ends of the accordion pleats 390 near the base wall 310 remains substantially constant, and the remaining portions of some or all of the accordion pleats 390 can fan out. For example, in some embodiments, portions of the accordion pleats 390 that are disposed in the attachment flanges 322, 324 can spread further apart than portions of the accordion pleats 390 that are disposed in the side walls 312, 314 nearer the base wall 310.

Figure 7:
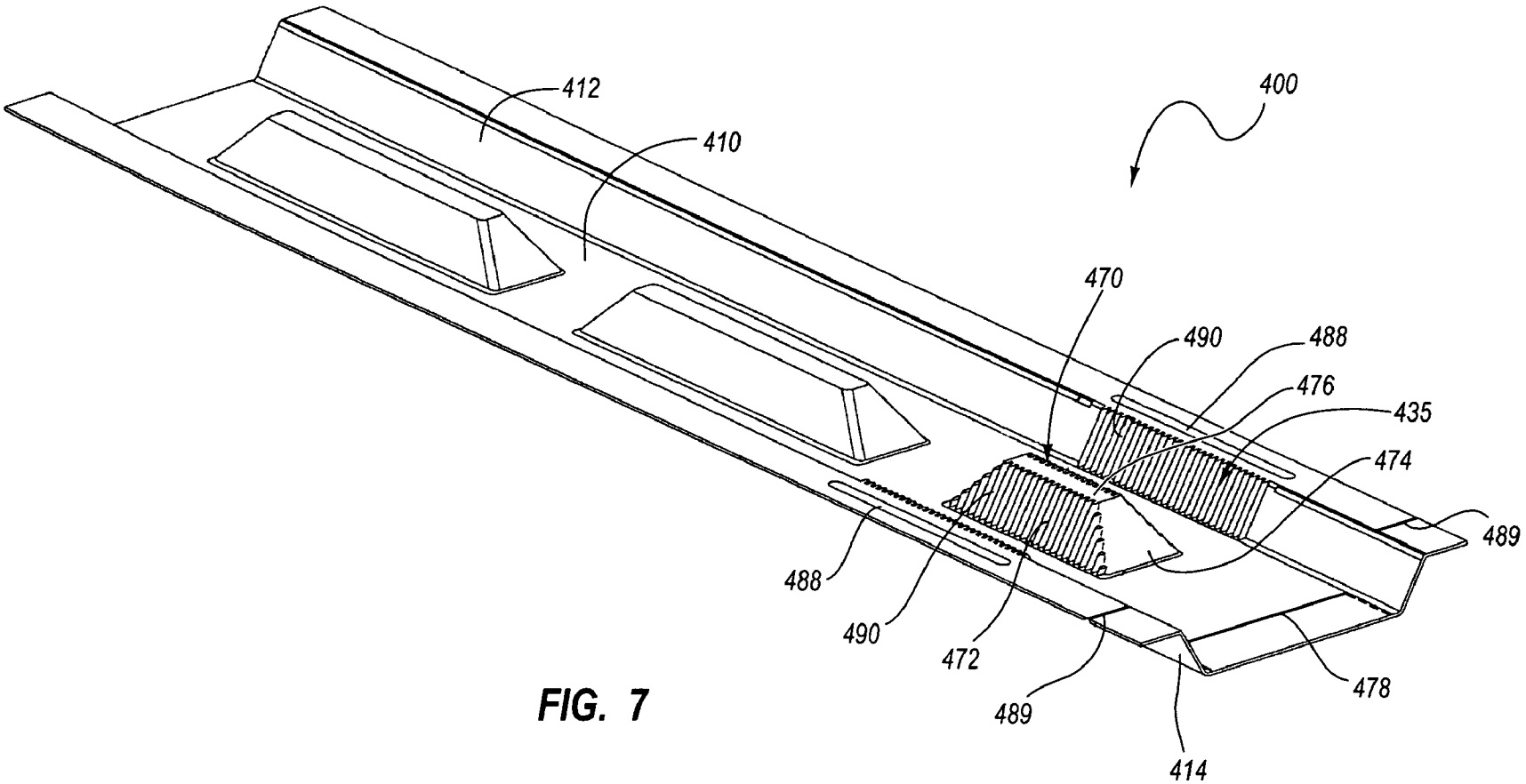
FIG. 7 illustrates a top perspective view of another embodiment of a vent baffle.

FIG. 7 illustrates an embodiment of a vent baffle 400 such as the vent baffle 100. The vent baffle 400 can comprise a base wall 410, a first side wall 412, and a second side wall 414. In the illustrated embodiment, the vent baffle 400 further includes a rib 470 disposed in a bending region 435. The rib 470 can resemble the rib 170 described above in many respects, and can comprise opposing side surfaces 472, opposing frontal surfaces 474, and a top surface 476. In some embodiments, the opposing frontal surfaces 474 and the top surface 476 are substantially smooth and planar. In further embodiments, the vent baffle comprises reinforcement members 488 such as the reinforcement members 186 described above, and can comprise folding lines 478, 489 such as the folding lines 178, 189 described above.

The vent baffle 400 can include a bending region 435 such as the bending region 135. However, the bending region 435 can include two separate sets of accordion pleats 490. A first set of accordion pleats 490 can be contained in the first side wall 412, the base wall 410, and a first side surface (not shown) of the rib 470. The second set of accordion pleats 490 can be contained in the second side wall 414, the base wall 410, and a second side surface 472 of the rib 470.

The rib 470 can, in some instances, serve a similar function as certain embodiments of the ribs 170 described above, in that it can provide structural rigidity to vent baffle 400. As with the top surface 176 of the ribs 170, the top surface 476 of the rib 470 (or a portion thereof) can be placed in contact with an underside of a roof.

The rib 470 can also provide structural reinforcement to the bending structure 435, which can be advantageous in some applications. For example, in some embodiments, the accordion pleats 490 can be more compliant, more stretchy, or springier than other portions of the vent baffle 400, and thus can be more prone to twisting, bending, or other deformations. Separating the first and second sets of accordion pleats 490 with a strip of un-pleated material can reinforce the bending structure 435. Moreover, in some embodiments, this added reinforcement does not detract from the ability of the vent baffle 400 to bend easily and adapt to the configuration of a roofing structure during installation.

Figure 8:
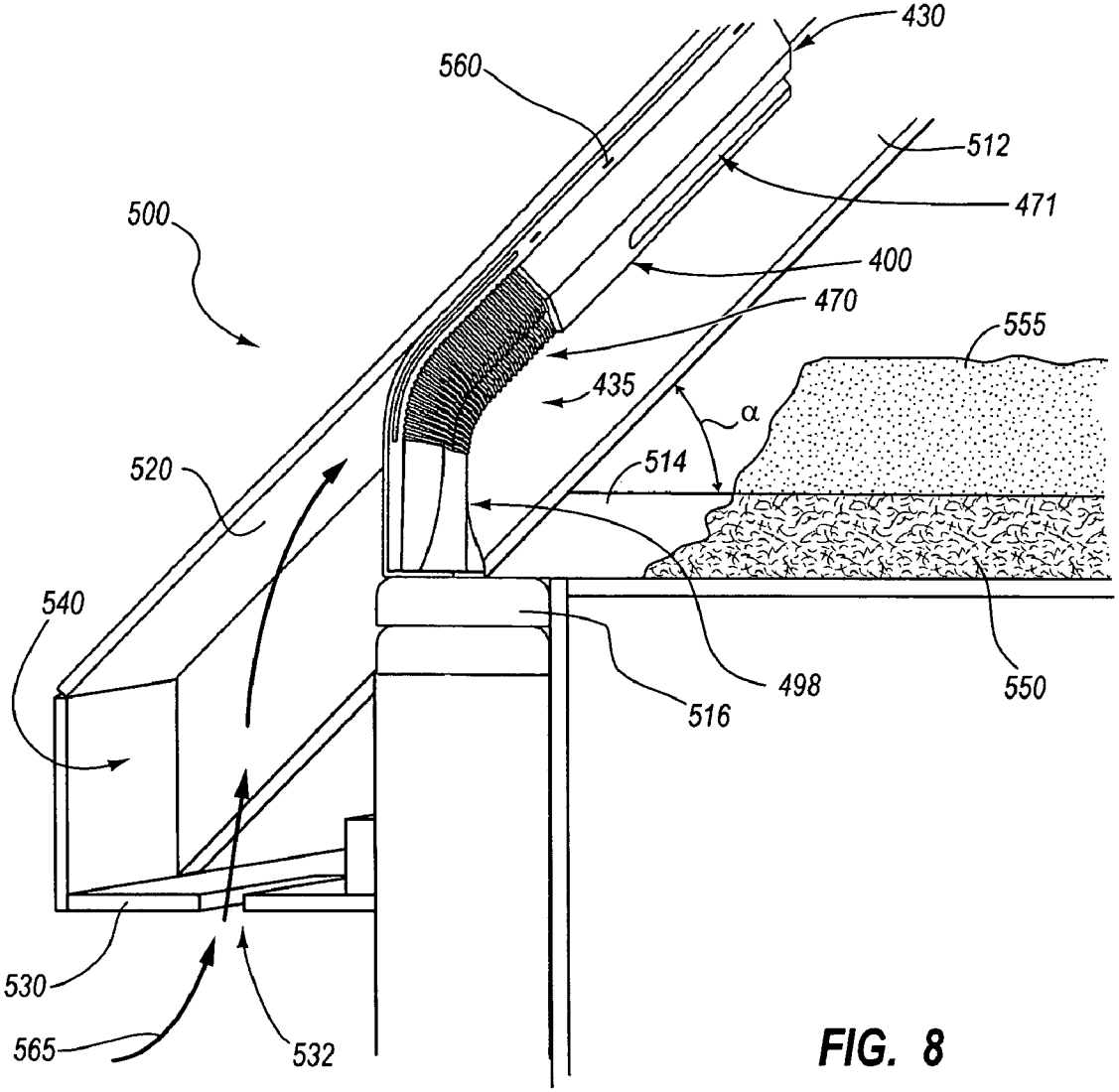
FIG. 8 illustrates a bottom perspective view of the vent baffle of FIG. 7 installed in an illustrative roofing arrangement.

FIG. 8 illustrates an embodiment of the vent baffle 400 installed in a first embodiment of a roofing structure 500. The roofing structure 500 is provided for illustrative purposes only, and is not intended to limit the varieties of roofing structures in which the vent baffle 400 can be employed. In the illustrated embodiment, the roofing structure 500 can comprise a series of rafters 512 and joists 514 positioned on a top plate 516. Roofing panels 520 can be positioned atop the rafters 512, and a soffit 530 can extend between a lower end of the rafters 512 and a building. The soffit 530 can define one or more soffit openings 532, which can provide for fluid communication between an exterior and an interior of the roofing structure 500. For example, the soffit openings 532 can permit airflow into a soffit region 540, which can generally comprise a portion of the roofing structure 500 in the vicinity of the soffit 530.

In some embodiments, the roofing structure 500 can include insulation sheets 550 (e.g., fiberglass insulation) and/or loose insulation 555. In some embodiments, the insulation sheets 550 are inserted between adjacent joists 514 and the loose insulation 555 is applied on top of the insulation sheets 550. For example, the loose insulation 555 can be blown into place. The insulation sheets 550 and the loose insulation 555 can generally abut against an underside (e.g., an attic-facing side) of the vent baffle 400. However, in the illustrated embodiment, the insulation sheets 550 and the loose insulation 555 are shown partially cutaway for purposes of discussion.

In certain embodiments, the vent baffle 400 is inserted between adjacent rafters 512 and is secured to a roofing panel 520 and/or the rafters 512. For example, in the illustrated embodiment, staples 560 secure the vent baffle 400 to the roofing panel 520.

In further embodiments, a bottom end of the vent baffle 400 can be secured to a portion of the roofing structure 500, such as the top plate 516. In the illustrated embodiment, the vent baffle 400 has been folded along folding lines, such as the folding lines 178, 189 discussed above, and the bottom end of the vent baffle 400 has been secured to the top plate 516 via staples. In other embodiments, only a portion of the bottom end of the vent baffle 400 (e.g., a tab portion, such as the tab portion 181 discussed above) is folded and secured to the roofing structure 500. In various embodiments, the bottom end of the vent baffle 400 can be secured to the roofing structure 500 either before or after an upper end of the vent baffle 400 is secured to the roofing panels 520, depending on, for example, installer preference or ease of installation.

As depicted by arrows 565, airflow can proceed from outside the roofing structure 500, through the soffit opening 532, through the soffit region 540, and into a channel 430 defined by the vent baffle 400. The channel 430 can direct airflow past an underside of the roofing panels 520, which can prevent or reduce condensation. In some embodiments, the roofing structure 500 can include a crest vent or a ridge vent (not shown) to permit air that has been channeled through the vent baffle 400 to escape from the roofing structure 500 back into the surrounding environment.

In certain embodiments, the bending region 435 if the vent baffle 400 can gently slope from the lower portion 498 of the vent baffle 400 to an upper portion 499 thereof. The gently sloping transition defined by the bending region 435 can gently direct airflow from the soffit region 540 into the channel 430, and as a result, the airflow can be relatively free of turbulence and can be channeled relatively efficiently.

As discussed above, the vent baffle 400 can comprise various features that provide structural rigidity such that the vent baffle 400 can resist being compressed or otherwise deformed so as to collapse and thereby block or restrict the channel 430. The vent baffle 400 can be sufficiently rigid to withstand, for example, placement of the loose fill insulation 555 within the roofing structure 500. The vent baffle 400 can comprise one or more ribs 471, such as the ribs 170 described above. Additionally, as previously discussed, the vent baffle 400 can comprise the rib 470, which can be positioned in the bending region 435. The ribs 470, 471 can be placed against or near the underside of the roofing panels 520.

In some embodiments, a lower portion 498 of the vent baffle 400 can provide a barrier between an internal region of the roofing structure 500 (e.g., an attic) and the soffit region 540. For example, the lower portion 498 can prevent loose fill insulation 555 from entering the soffit region 540 and either escaping through the soffit opening 532 or blocking the soffit opening 532.

Figure 9:
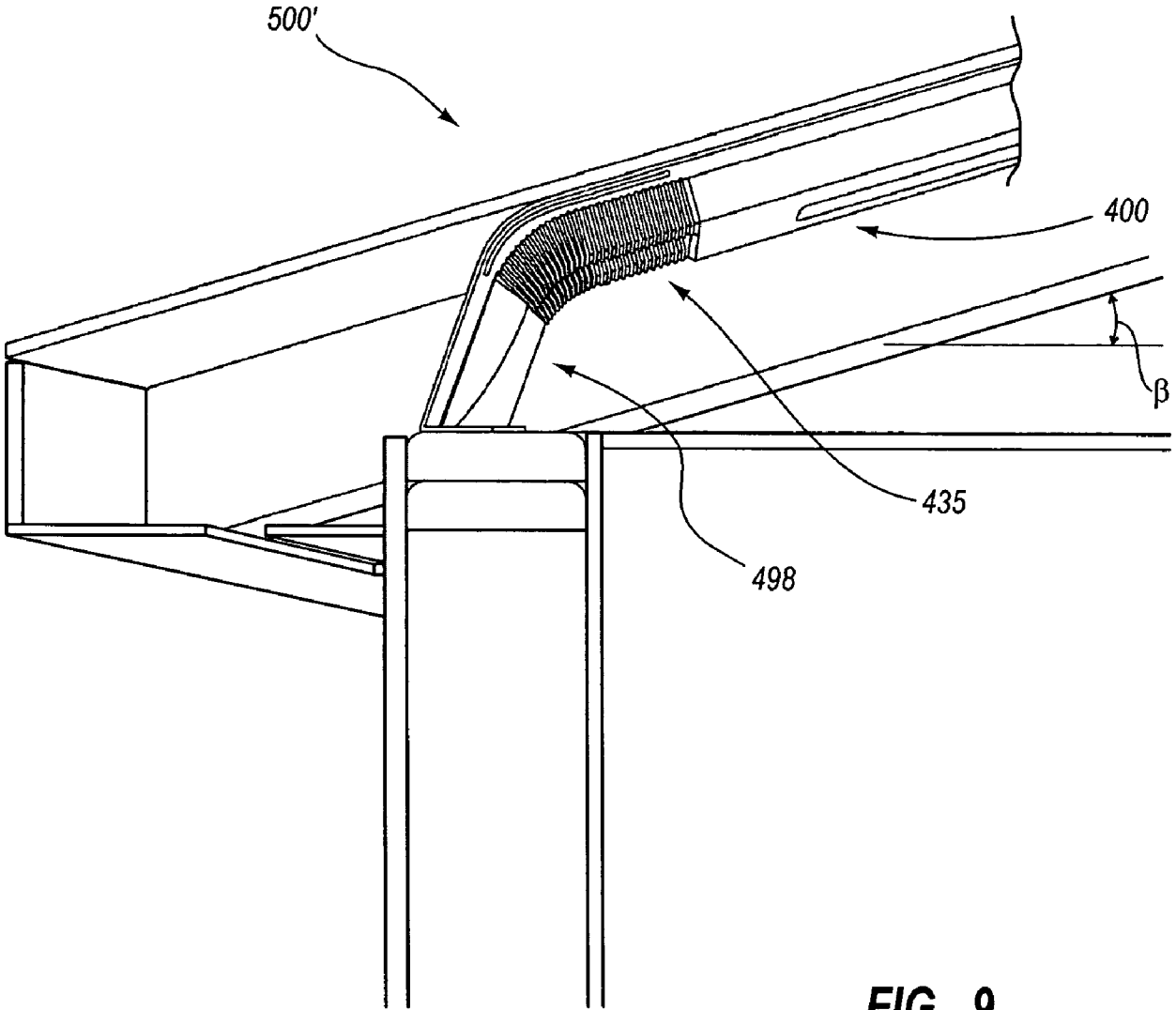
FIG. 9 illustrates a bottom perspective view of the vent baffle of FIG. 7 installed in another illustrative roofing arrangement that has a shallower pitch than the roofing arrangement of FIG. 8.

With reference to FIGS. 8 and 9, the vent baffle 400 can be configured for installation in roofing structures that have different pitches. For example, the roofing structure 500 in FIG. 8 can define a pitch angle $\alpha$ and a roofing structure 500' FIG. 9 can define a pitch angle $\beta$. The bending region 435 can permit the vent baffle 400 to be readily adapted to the different roofing configurations that can result from the differing pitch angles $\alpha,\beta$. For example, in the illustrated embodiments, the lower portion 498 is substantially vertical when installed in the roofing structure 500, but is angled so as to be non-vertical when installed in the roofing structure 500' and can thereby accommodate a narrower installation space that results from the shallower pitched roof.

In certain embodiments, a vent baffle 400 capable of adapting to a variety of roof pitches can reduce inventory costs, as a single product can be stocked for use in multiple applications. Additionally, such a vent baffle 400 can provide for faster and easier installation. For example, the bending region 435 can permit placement of the vent baffle 400 in a wide range of orientations that will function properly (e.g., provide a barrier to a soffit region and/or channel airflow against the roofing panels). Such versatility and adaptability can ease tolerance restraints at both the manufacturing and installation stages. For example, in some cases, the vent baffle 400 can compensate for errors made by an installer or by a designer of the roofing structure 500. If a portion of the vent baffle 400 is installed in an unintended position (e.g., too low or too high against the roofing panels), for example, the vent baffle 400 can be bent or rotated through a larger or smaller angle to compensate for the error.

Moreover, the bending region 435 can define a rounded or gently sloping transition between the lower portion 498 and the upper portion 499 of the vent baffle 498 in any of a variety of configurations. For example, in some embodiments, the vending region 435 can provide a gently sloping transition when the lower portion 498 is oriented relative to the upper portion 499 at an angle that is within a range of between about 5 degrees and about 90 degrees, between about 10 degrees and about 80 degrees, or between about 20 degrees and about 70 degrees.

In further embodiments, the vent baffle 400 can be particularly well-suited for use in roofing structures 500, or portions of particular roofing structures 500, that have tight space constraints. For example, in some embodiments, a vent baffle 400 having portions that condense as the vent baffle 400 is adjusted for installation can facilitate manipulation of the vent baffle 400 into tight spaces.

In some embodiments, adjustments to the vent baffle 400 can be made simply and without time-intensive actions by the installer. For example, the installer can simply bend the baffle 400 to a larger or lesser extent as needed, without performing the acts of measuring, folding, cutting, tearing, or otherwise manipulating the baffle 400. Additionally, in some embodiments, the structural integrity and strength of the bending region 435 can be maintained as transitions through a large range of bending angles (e.g., between about 0 degrees and about 90 degrees). Accordingly, small adjustments to the bending angle or other orientation of the baffle 400 can have relatively insignificant effects on the ability of the baffle 400 to maintain a barrier between an interior region of the roofing structure 500 and the soffit region 540 and/or the roofing panels 520.

More generally, in certain embodiments, installation of the vent baffle 400 can advantageously involve relatively few procedural acts. For example, in some embodiments, orienting the vent baffle 400 for installation can involve merely bending the bending region 435 without measuring, folding, cutting, tearing, or otherwise manipulating the baffle 400.

Figure 10:
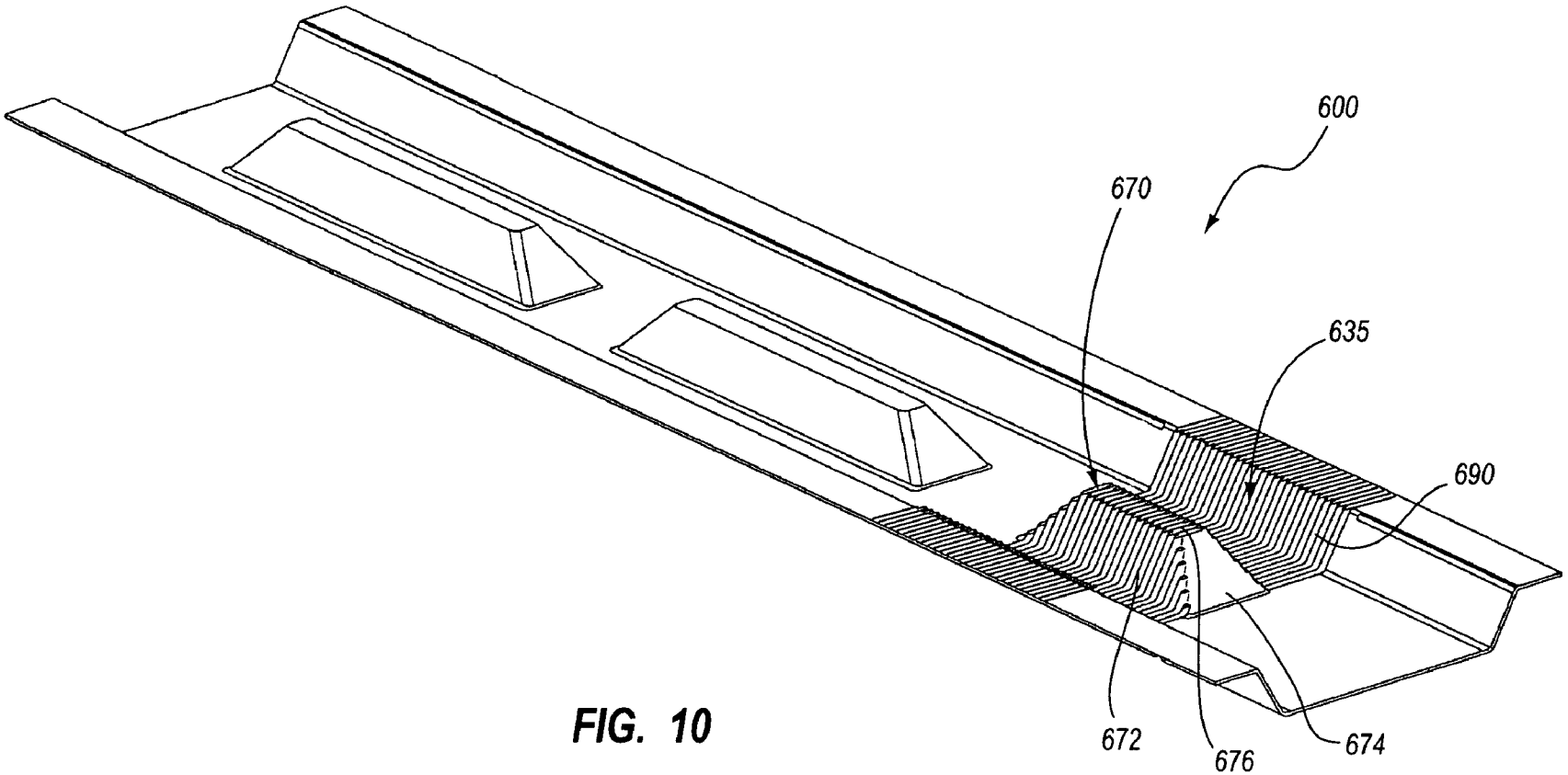
FIG. 10 illustrates a top perspective view of another embodiment of a vent baffle.

FIG. 10 illustrates an embodiment of a vent baffle 600 such as the vent baffle 400. The vent baffle 600 can include a bending region 635 and a rib 670 positioned within the bending region 635. The bending region 635 can comprise accordion pleats 690 that extend across a full width of the vent baffle 600. Moreover, in some embodiments, opposing side surfaces 672, opposing frontal surfaces 674, and a top surface 676 of the rib 670 can comprise portions of the accordion pleats 690. In some embodiments, some portions of the accordion pleats 690 can expand and other portions of the accordion pleats 690 can contract as the vent baffle 600 is moved from a substantially columnar configuration to a bent configuration.

Figure 11:
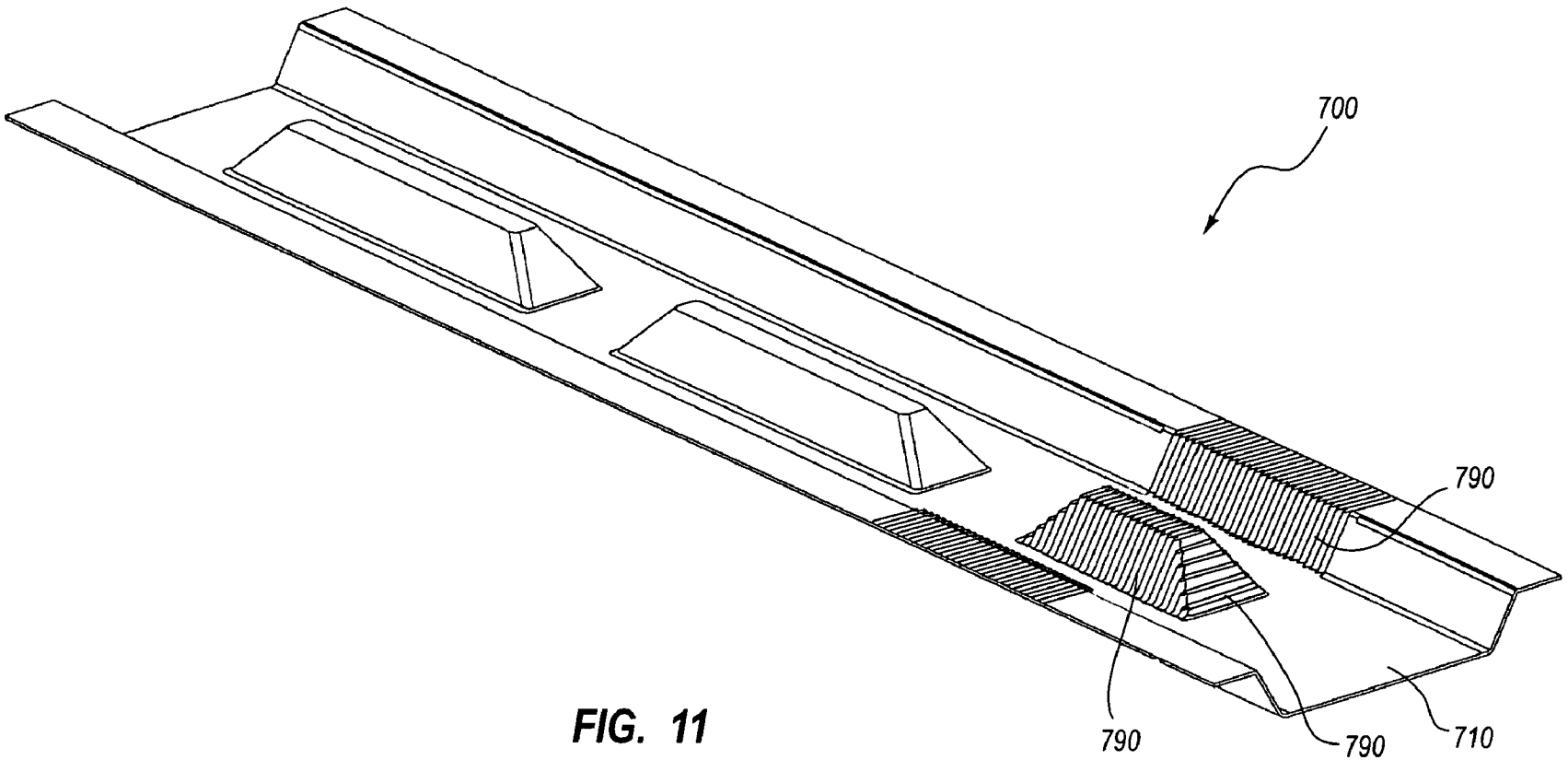
FIG. 11 illustrates a top perspective view of another embodiment of a vent baffle.

FIG. 11 illustrates an embodiment of a vent baffle 700 such as the vent baffle 600. The vent baffle 700 can differ from the illustrated embodiment of the vent baffle 600 in that a base wall 710 of the vent baffle 700 does not include portions of accordion pleats 790. The vent baffle 700 can be configured to bend in a manner such as that described above with respect to the vent baffle 300.

Figure 12:
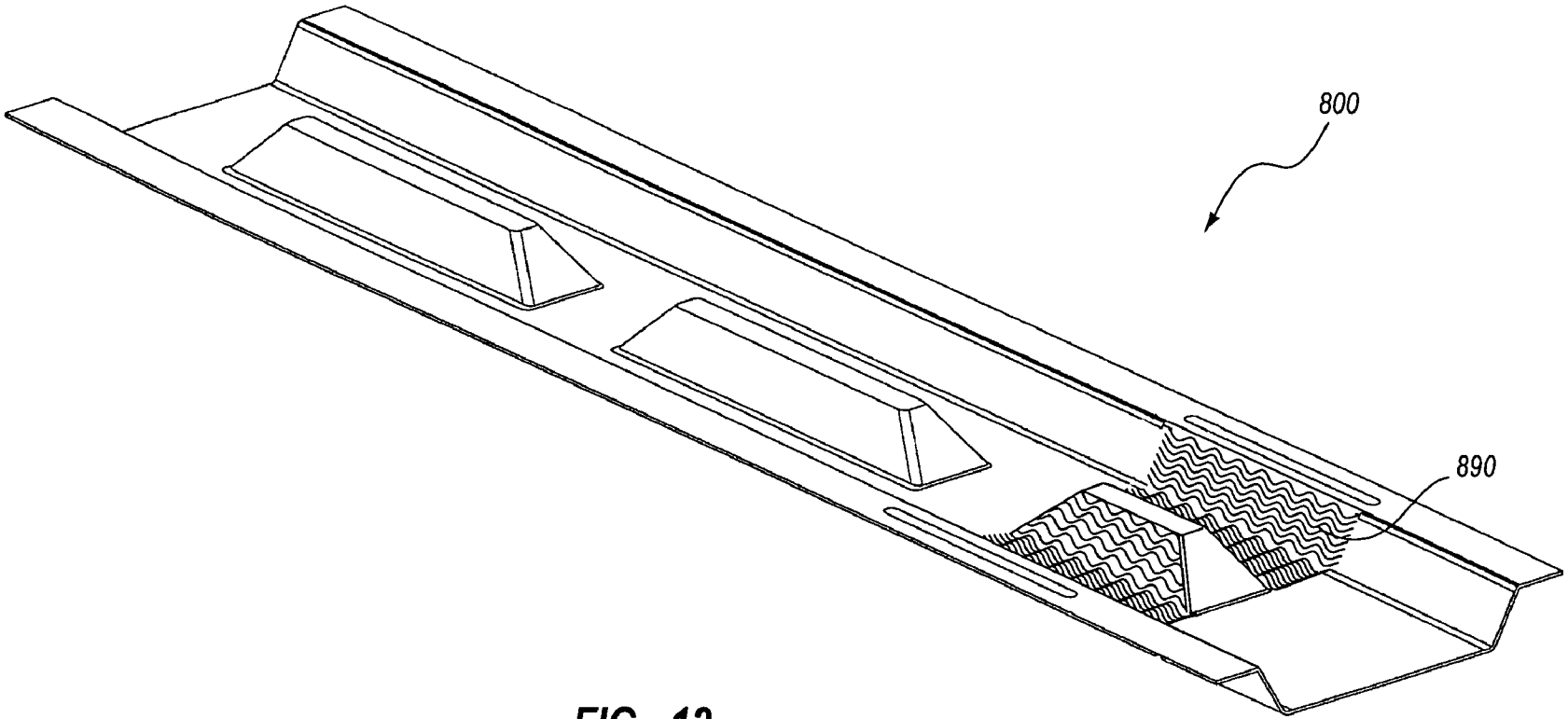
FIG. 12 illustrates a top perspective view of another embodiment of a vent baffle.

FIG. 12 illustrates an embodiment of a vent baffle 800 such as the vent baffle 400. The vent baffle 800 can differ from the illustrated embodiment of the vent baffle 400 in that the vent baffle 800 comprises accordion pleats 890 that define a cross-sectional profile such as that shown in FIG. 3C.

Figure 13:
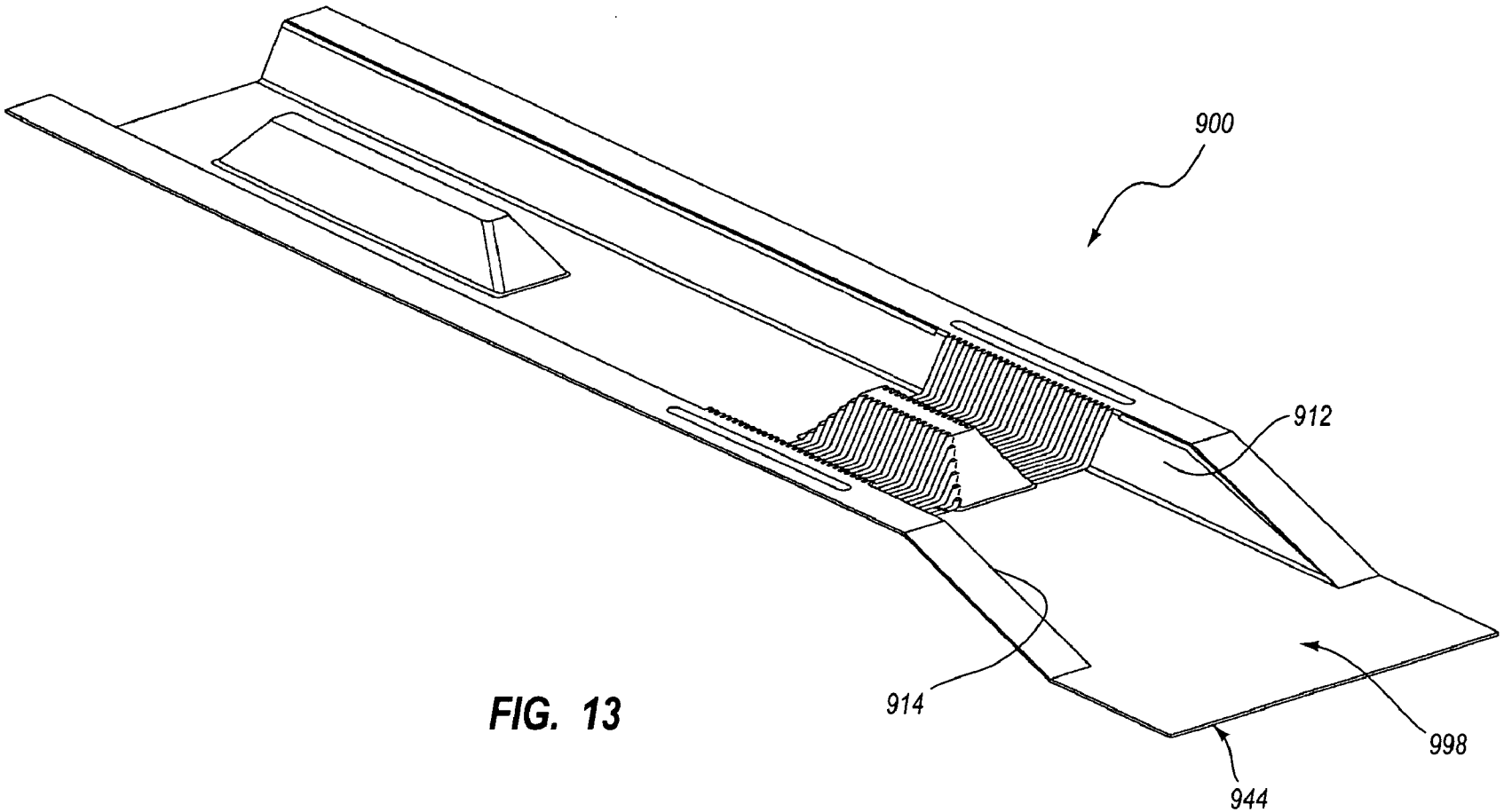
FIG. 13 illustrates a top perspective view of another embodiment of a vent baffle.

FIG. 13 illustrates an embodiment of a vent baffle 900 such as the vent baffle 400. The vent baffle 900 can differ from the illustrated embodiment of the vent baffle 400 in that the vent baffle 900 includes a first side wall 912 and a second side wall 914 that taper toward a bottom end 944 of the vent baffle 900. In certain of such embodiments, a bottom portion 998 of the of the vent baffle 900 can be readily folded at or near a position where the first and second side walls 912, 914 end.

Figure 14:
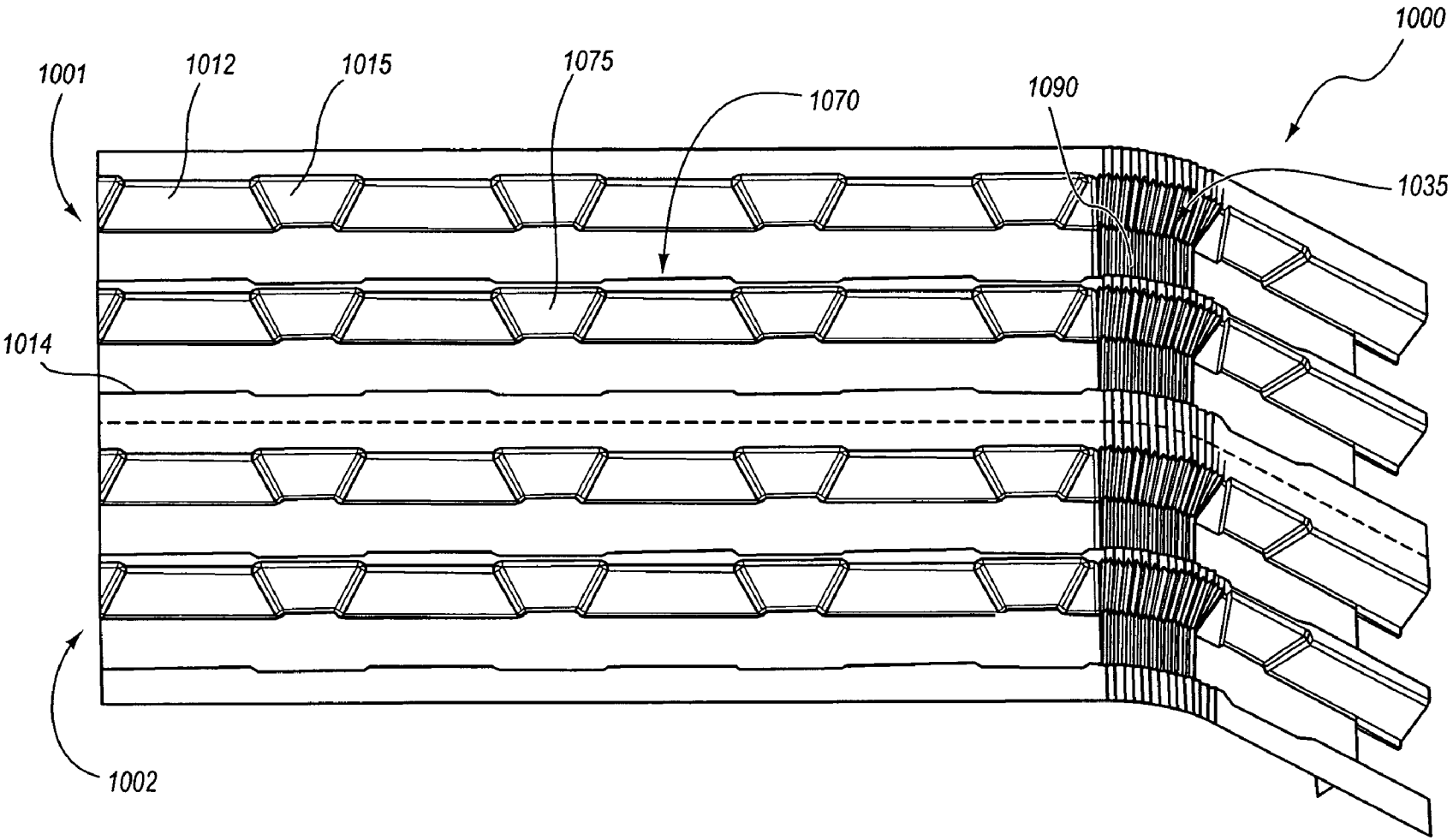
FIG. 14 illustrates a top perspective view of another embodiment of a vent baffle that is in a bent configuration.

FIG. 14 illustrates an embodiment of a vent baffle 1000 that can resemble the vent baffles described herein. In some embodiments, the vent baffle 1000 is separable into two smaller vent baffles 1001, 1002. The vent baffles 1001, 1002 can be substantially identical to each other. Accordingly, references to the vent baffle 1001 can apply to the vent baffle 1002 as well.

In certain embodiments, the vent baffle 1001 comprises a first side wall 1012 and a second side wall 1014. Each of the first and second side walls 1012, 1014 can comprise one or more indented regions 1015, which can provide structural reinforcement to the side walls 1012, 1014. In some embodiments, the indented regions 1015 are substantially trapezoidal. Other configurations are also possible.

In some embodiments, the vent baffle 1001 comprises a rib 1070 that extends along substantially a full longitudinal length of the vent baffle 1001. In some embodiments, the rib 1070 comprises indented regions 1075 such as the indented regions 1015. In further embodiments, the indented regions 1075 are positioned at substantially the same longitudinal positions as the indented regions 1015. In other embodiments, the indented regions 1075 can comprise different configurations than and/or can be spaced at different intervals from the indented regions 1015.

In some embodiments, the vent baffle 1001 comprises a bending region 1035, which can comprise accordion pleats 1090 that extend from a first outside lateral edge of the vent baffle 1001 to a second outside lateral edge of the vent baffle 1001. Accordingly, in some embodiments, the rib 1070 comprises at least a portion of the accordion pleats 1090.

Various modifications, changes, and variations apparent to those of skill in the art may be made in the arrangement, operation, and details of the apparatus and methods detailed in this disclosure without departing from the spirit and scope of the disclosure. Thus, it is to be understood that the embodiments described above have been presented by way of example, and not limitation. Any suitable combination of the features described above is contemplated. For example, in various embodiments, any of the bending regions and/or ribs discussed above can be incorporated into any of the vent baffles discussed above. Moreover, each embodiment recited in the claims that follow is incorporated herein as a separate embodiment.

The invention claimed is:

1. A vent baffle comprising:

a base wall elongated in a longitudinal direction such that the vent baffle defines a maximum length in the longitudinal direction that is greater than a maximum width of the vent baffle in a transverse direction that is perpendicular to the longitudinal direction;

a first side wall extending upwardly from the base wall;

a second side wall extending upwardly from the base wall, wherein the base wall cooperates with the first and second side walls to define a channel that is open above the base wall such that the channel is configured to direct airflow past an underside of a roof;

a bending region that is configured to permit the vent baffle to transition from a columnar orientation to a bent orientation and that extends in the longitudinal direction, the bending region comprising a first set of accordion pleats that are present when the vent baffle is in the columnar orientation and that are configured to move relative to each other so as to permit the vent baffle to transition to the bent orientation, wherein the accordion pleats are arranged serially in the longitudinal direction such that at least a first accordion pleat is adjacent to a second accordion pleat in the longitudinal direction, and wherein at least a portion of the first accordion pleat is configured to one or more of expand and contract relative to at least a portion of the second accordion pleat in the longitudinal direction when the vent baffle is transitioned from the columnar orientation to the bent orientation; and a reinforcement member that extends in the longitudinal direction alongside the bending region with a length in the longitudinal direction that substantially corresponds with a length of the bending region in the longitudinal direction, wherein the reinforcement member is configured to resist transitioning of the vent baffle from the columnar orientation to the bent orientation.

2. The vent baffle of claim 1, wherein the accordion pleats extend in a direction substantially transverse to the longitudinal direction of the base wall.

3. The vent baffle of claim 2, wherein the bending region is constricted to one or more of the base wall, the first side wall, and the second side wall, and wherein the bending region further comprises a second set of accordion pleats that extend in a direction substantially transverse to the longitudinal direction of the base wall and are spaced from the first set of accordion pleats.

4. The vent baffle of claim 3, wherein the first set of accordion pleats and the second set of accordion pleats are separated from each other via at least a portion of a rib that extends in the longitudinal direction.

5. The vent baffle of claim 1, wherein the reinforcement member comprises a rib structure.

6. The vent baffle of claim 1, wherein an attachment flange that extends from the first side wall comprises the reinforcement member.

7. The vent baffle of claim 6, wherein the reinforcement member is integrally formed with the attachment flange.

8. The vent baffle of claim 1, wherein at least a portion of the first set of accordion pleats extend between the first side wall and the second side wall.

9. The vent baffle of claim 1, wherein the first set of accordion pleats defines a cross-sectional profile that resembles one of a sine wave and a triangle wave.

10. The vent baffle of claim 1, wherein the base wall comprises at least a portion of the bending region, and wherein the bending region is at an intermediate position within the base wall such that a first portion of the base wall on one side of the bending region extends in a first direction and a second portion of the base wall on another side of the bending region is configured to extend in a second direction that is nonparallel to the first direction when the vent baffle is bent.

11. The vent baffle of claim 1, wherein the bending region further comprises a second set of accordion pleats arranged serially such that at least one accordion pleat within the second set is adjacent to another accordion pleat within the second set.

12. The vent baffle of claim 11, wherein the first set of accordion pleats is separated from the second set of accordion pleats by at least a portion of a structural rib that extends in the longitudinal direction and is positioned between the first and second side walls.

13. The vent baffle of claim 11, wherein an extent of the first set of accordion pleats in the longitudinal direction is approximately the same as an extent of the second set of accordion pleats in the longitudinal direction.

14. The vent baffle of claim 1, wherein a longitudinal extent of the bending region is within a range of between about 1/20 and about 1/4 of a longitudinal length of the vent baffle.

15. The vent baffle of claim 1, wherein at least portions of multiple sets of adjacent accordion pleats are configured to compact toward each other simultaneously as the vent baffle bends at the bending region.

16. The vent baffle of claim 15, wherein at least portions of multiple sets of adjacent accordion pleats are configured to spread apart from each other simultaneously as the vent baffle bends at the bending region.

17. The vent baffle of claim 1, wherein at least portions of multiple sets of adjacent accordion pleats are configured to spread apart from each other as the vent baffle bends at the bending region.

18. The vent baffle of claim 1, wherein when the vent baffle is in the columnar orientation, a cross-sectional profile of an upper surface of the accordion pleats is substantially the same as a cross-sectional profile of a lower surface of the accordion pleats.

19. The vent baffle of claim 1, wherein the bending region comprises a foam material.

20. The vent baffle of claim 1, wherein a structural rib that extends in the longitudinal direction comprises at least a portion of the first set of accordion pleats.

21. The vent baffle of claim 1, wherein the bending region comprises polystyrene, high impact polystyrene, rubber base polystyrene, polypropylene, or paper fiber.

22. The vent baffle of claim 1, wherein a cross-section of the first accordion pleats includes substantially V-shaped portions.

23. A vent baffle for installation in a roofing structure, the vent baffle comprising:

a base wall elongated in a longitudinal direction such that the vent baffle defines a maximum length in the longitudinal direction that is greater than a maximum width of the vent baffle in a transverse direction that is perpendicular to the longitudinal direction, the base wall comprising a first region and a second region;

a first side wall extending from the base wall;

a second side wall extending from the base wall, wherein the base wall cooperates with the first and second side walls to define a channel that is open above the base wall such that the channel is configured to direct airflow past an underside of a roof;

a bending region extending in the longitudinal direction, wherein the first and second regions of the base wall are connected to opposite longitudinal ends of the bending region, wherein the bending region is configured to permit the second region of the base wall to transition from an original orientation relative to the first portion of the base wall to a displaced orientation relative to the first portion of the base wall, and wherein the bending region comprises a plurality of accordion pleats that extend transversely relative to the longitudinal direction and that are configured to do one or more of compress and expand relative to each other when the second region of the base wall is transitioned from the original orientation to the displaced orientation; and an attachment flange extending from an upper end of the first side wall so as to have an inner edge at the upper end of the first side wall and an outer edge that is spaced from the inner edge, wherein the attachment flange comprises a reinforcement member that extends in the longitudinal direction alongside the bending region and is spaced from both the inner and outer edges of the attachment flange, and wherein the reinforcement member is configured to resist transitioning of the second region of the base wall from the original orientation to the displaced orientation.

24. The vent baffle of claim 23, wherein the reinforcement member comprises a rib structure.

25. The vent baffle of claim 24, wherein the vent baffle further comprises a second reinforcement member, and wherein the first and second reinforcement members are at opposite sides of the bending region.

26. The vent baffle of claim 23, wherein the reinforcement member is integrally formed with the attachment flange.

27. The vent baffle of claim 23, wherein the attachment flange comprises portions that extend alongside the first and second regions of the base wall, and wherein the attachment flange is configured to bend so as to define a rounded transition between the portions that extend alongside the first and second regions of the base wall.

28. The vent baffle of claim 27, wherein the first side wall comprises a portion of the bending region.

29. The vent baffle of claim 23, wherein the bending region is configured to deform elastically.

30. The vent baffle of claim 23, wherein the bending region is configured to permit the second region of the base to transition from the original orientation to the displaced orientation without any folding, cutting, or tearing of the bending region.

31. A vent baffle for installation in a roofing structure, the vent baffle comprising:

a base wall elongated in a longitudinal direction such that the vent baffle defines a maximum length in the longitudinal direction that is greater than a maximum width of the vent baffle in a transverse direction that is perpendicular to the longitudinal direction, the base wall comprising a first region and a second region;

a first side wall extending from the base wall;

a second side wall extending from the base wall, wherein the base wall cooperates with the first and second side walls to define a channel that is open above the base wall such that the channel is configured to direct airflow past an underside of a roof, and wherein the channel is open at longitudinally opposite ends of the vent baffle;

a bending region extending in the longitudinal direction between the first and second regions of the base wall, the bending region comprising a plurality of accordion pleats arranged serially in the longitudinal direction, and wherein the bending region is configured to permit the second region of the base wall to transition from an original orientation relative to the first portion of the base wall to a displaced orientation relative to the first portion of the base wall, wherein the plurality of accordion pleats are present in the bending region when the base wall is in the original orientation, and wherein the plurality of accordion pleats are configured to move relative to each other so as to permit the second region of the base wall to transition from the original orientation to the displaced orientation;

a first attachment flange extending transversely from an upper end of the first side wall alongside at least a portion of the first and second regions of the base wall and alongside the bending region; and a second attachment flange extending transversely from an upper end of the second side wall alongside at least a portion of the first and second regions of the base wall and alongside the bending region, wherein each of the first and second attachment flanges is configured to be attached to an underside of a roof at an exterior of the channel, wherein each of the first and second attachment flanges comprises a reinforcement member extending in the longitudinal direction alongside the bending region, wherein the reinforcement member is configured to resist movement of the second region of the base wall from the original orientation to the displaced orientation, and wherein the portion of each of the first and second attachment flanges that extends alongside the bending region is configured to bend so as to define a rounded transition between the remaining portions of the first and second attachment flanges, respectively, such that the attachment flanges adjust to conform to the underside of the roof.

32. The vent baffle of claim 31, further comprising a structural rib that extends upwardly from the base wall within the bending region.

33. The vent baffle of claim 31, wherein the bending region is configured to compress as the second portion of the base wall transitions from the original orientation to the displaced orientation.

34. The vent baffle of claim 31, wherein portions of adjacent accordion pleats compress toward each other while other portions of adjacent accordion pleats maintain their spacing relative to each other during transition of the second region of the base wall from the original orientation to the displaced orientation.

35. The vent baffle of claim 31, wherein the reinforcement member comprises a structural rib.

36. The vent baffle of claim 31, wherein the first attachment flange defines a lateral edge that is opposite the first side wall, and wherein the reinforcement member of the first attachment flange is at a position between the lateral edge and the first side wall.

* * * * *